US010675653B2

(12) United States Patent
Tudor et al.

(10) Patent No.: US 10,675,653 B2
(45) Date of Patent: Jun. 9, 2020

(54) MOTORIZED CARTRIDGE TYPE FLUID DISPENSING APPARATUS AND SYSTEM

(71) Applicant: NORDSON CORPORATION, Westlake, OH (US)

(72) Inventors: Thomas R. Tudor, Westland, MI (US); Jerry R. Routen, Westland, MI (US); William C. Paetow, II, Pinckney, MI (US); Jeffry J. Grana, Holland, OH (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 15/426,999

(22) Filed: Feb. 7, 2017

(65) Prior Publication Data

US 2018/0221909 A1 Aug. 9, 2018

(51) Int. Cl.
*B05C 5/02* (2006.01)
*B05B 9/047* (2006.01)
(Continued)

(52) U.S. Cl.
CPC ..... *B05C 5/0225* (2013.01); *B05B 9/047* (2013.01); *B05B 13/0431* (2013.01); *B05C 11/023* (2013.01)

(58) Field of Classification Search
CPC ... B05C 5/0225; B05C 5/0229; B05C 5/0233; B05C 5/0237; B05C 11/1002;
(Continued)

(56) References Cited

U.S. PATENT DOCUMENTS 1,555,711 A 9/1925 Hershinger
1,709,445 A 4/1929 Austen
(Continued)

FOREIGN PATENT DOCUMENTS

DE 10313051 A1 10/2004
EP 0311256 A1 4/1989
(Continued)

OTHER PUBLICATIONS

PCT/US2016/036959; Int'l Preliminary Report on Patentability; dated Dec. 21, 2017; 8 pages.
(Continued)

*Primary Examiner* — Cody J Lieuwen
(74) *Attorney, Agent, or Firm* — Baker & Hostetler LLP

(57) ABSTRACT

A dispensing apparatus is disclosed for dispensing fluid, such as liquid adhesive, from a fluid cartridge having a plunger movable between opposite ends within the cartridge. The dispensing apparatus is releasably coupled to a robot in order to control discharging of the fluid at a particular location. Movement of the plunger is carried out by a cartridge actuator assembly that includes a linear actuator, such as a servomotor, that moves a piston rod into engagement with the plunger such that the plunger can be movable under a force applied by the piston rod. A dispense section of the dispensing apparatus includes a valve assembly with a snuff-back mechanism that prevents excess dripping from an outlet of the dispenser. An end effector assembly may be coupled to the dispense section for dispensing the fluid to an application site in a precise and controlled manner.

26 Claims, 14 Drawing Sheets

(51) Int. Cl.
*B05B 13/04* (2006.01)
*B05C 11/02* (2006.01)

(58) Field of Classification Search
CPC ... B05C 11/1026–1031; B05C 11/1039; B05B 9/047; B05B 13/0278; B05B 13/0431; B05B 13/62; B05B 15/531; B05B 15/52; B05B 11/0054; B65D 83/0022
USPC ..... 239/119, 321, 600; 222/153.01, 153.03, 222/153.09, 173, 182, 325–327, 386, 387
See application file for complete search history.

(56) References Cited

U.S. PATENT DOCUMENTS 3,443,725 A 5/1969 Lawhorn
3,767,085 A 10/1973 Cannon et al.
3,851,801 A 12/1974 Roth
4,641,764 A 2/1987 Faulkner, III
4,724,983 A 2/1988 Claassen
4,771,920 A 9/1988 Boccagno et al.
4,811,863 A 3/1989 Claassen
4,846,373 A 7/1989 Penn et al.
4,878,981 A 11/1989 Mizutani
4,925,061 A 5/1990 Jeromson et al.
4,932,094 A 6/1990 McCowin
4,974,752 A 12/1990 Sirek
5,069,365 A 12/1991 Woodhouse
5,074,443 A 12/1991 Fujii et al.
5,318,207 A 6/1994 Porter et al.
5,435,462 A 7/1995 Fujii
5,458,275 A 10/1995 Centea et al.
5,461,922 A 10/1995 Koen
5,467,899 A 11/1995 Miller
5,566,860 A 10/1996 Schiltz et al.
5,657,904 A 8/1997 Frates et al.
5,733,597 A 3/1998 Schmitkons et al.
5,799,578 A 9/1998 Junghans
5,836,482 A 11/1998 Ophardt et al.
5,852,244 A 12/1998 Englund et al.
5,875,928 A 3/1999 Mueller et al.
5,906,682 A 5/1999 Bouras et al.
5,927,560 A * 7/1999 Lewis ..... B05C 11/1034 222/263
5,944,226 A 8/1999 Schiltz et al.
5,984,147 A 11/1999 Van Ngo
6,036,106 A 3/2000 Peet
6,105,822 A 8/2000 Larsen et al.
6,131,770 A 10/2000 Allen
6,234,358 B1 5/2001 Romine et al.
6,234,359 B1 5/2001 Brown et al.
6,299,023 B1 10/2001 Amone
6,308,868 B1 * 10/2001 Hoffman ..... B05C 17/00576 222/153.01
6,311,868 B1 11/2001 Krietemeier et al.
6,422,427 B2 7/2002 Brown et al.
6,607,104 B2 8/2003 McGuffey
6,651,849 B2 11/2003 Schroeder et al.
6,715,506 B1 * 4/2004 Ikushima ..... B05C 5/0225 118/684
6,935,541 B1 8/2005 Campbell et al.
6,957,751 B2 10/2005 Ophardt
7,033,004 B2 4/2006 Ghisalberti et al.
7,237,578 B2 7/2007 Porter et al.
7,296,707 B2 11/2007 Raines et al.
7,331,482 B1 2/2008 Fugere
7,441,568 B2 10/2008 Porter et al.
7,648,052 B2 1/2010 Holm et al.
7,762,088 B2 7/2010 Fiske et al.
7,896,200 B2 3/2011 Nakatsuji et al.
8,544,686 B2 10/2013 Williams
8,662,352 B1 * 3/2014 des Jardins ..... B05B 15/25 222/167
9,027,796 B1 5/2015 Leitch
9,095,872 B2 8/2015 Topf et al.
9,387,504 B2 7/2016 Paetow et al.
9,656,286 B2 5/2017 Aigner et al.
10,328,452 B2 6/2019 Levand et al.
2002/0043539 A1 * 4/2002 Pagel ..... B05C 5/0225 222/207
2002/0130141 A1 9/2002 Gardos
2003/0044219 A1 * 3/2003 Quintero ..... A61B 17/00491 401/196
2003/0122095 A1 7/2003 Wilson et al.
2004/0074927 A1 4/2004 Lafond
2004/0226968 A1 11/2004 Lafond
2006/0016510 A1 1/2006 Porter et al.
2006/0193969 A1 8/2006 Prentice et al.
2008/0302477 A1 12/2008 Varga et al.
2010/0012743 A1 * 1/2010 Nakazono ..... B05B 5/1625 239/3
2011/0049189 A1 3/2011 Strobel-Schmidt et al.
2012/0252242 A1 * 10/2012 Beebe ..... B05C 5/0208 439/190
2014/0138406 A1 5/2014 Sanfilippo et al.
2014/0197198 A1 * 7/2014 Paetow ..... B05C 5/0225 222/55
2014/0326760 A1 * 11/2014 Topf ..... B05C 5/0225 222/559
2015/0083751 A1 * 3/2015 Aigner ..... B05C 17/00553 222/137
2016/0361734 A1 12/2016 Routen et al.
2017/0106401 A1 * 4/2017 Pringle, IV ..... B05C 9/02
2018/0221909 A1 8/2018 Tudor et al.

FOREIGN PATENT DOCUMENTS

EP 2851133 A1 3/2015
FR 2556984 A3 6/1985
JP 01-115466 A 5/1989
JP 2004-524143 A 8/2004
JP 2006-043703 A 2/2006
WO 2003/051526 A1 6/2003
WO 2016/201277 A1 12/2016

OTHER PUBLICATIONS

Lquid Control, Press Room, http://www.liquidcontrol.com/pressroom/pressrelease.aspx, Aug. 4, 2004, 2 pgs.
Liquid Control, Dispensit (Registered), Model 1053 MicroMelt, http://www.liquidcontrol.com/products/dispensit1053MicroMelt.aspx, Dec. 21, 2005, 2 pgs.
Liquid Control, Dispensit (Registered) Model 1053, http://www.liquidcontrol.com/products/dispensit1053.aspx, Nov. 29, 2005, 2 pgs.
Liquid Control, Dispensit (Registered) Model 1053, Rod Positive Displacement Dispense Valve, Brochure, 2003, 2 pgs.
International Patent Application No. PCT/US2016/036959; Int'l Search Report and the Written Opinion; dated Oct. 19, 2016; 14 pages.
Graco/Liquid Control, Dispensit (Registered) Model 1053 MicorMelt Programmable Precision Metering Valve, Brochure, 2006, 2 pgs.
European search report dated Oct. 5, 2018 for EP Application No. 18155425.

* cited by examiner

MOTORIZED CARTRIDGE TYPE FLUID DISPENSING APPARATUS AND SYSTEM

TECHNICAL FIELD

This disclosure generally relates to a fluid dispensing apparatus, and more particularly relates to a robot-mounted motorized fluid dispensing apparatus configured to dispense fluid from a cartridge.

BACKGROUND

The dispensing of fluid material at a precise location in a controlled manner presents many challenges due to the viscosity of the material and the precise location of delivery and form on an object. Conventional robot-mounted fluid dispensers are limited by the parameters of the robot, and thus often have significant performance limitations. For instance, the response time of conventional systems is relatively slow and not very accurate. As a consequence, the ability of the system to control an amount of dispensed fluid is limited, especially during rapid changes in the relative speed between a dispenser nozzle and the application site.

Moreover, various conventional fluid dispensing devices require extensive handling by an operator to load the fluid, which increases the risk of contamination. Such conventional devices are not capable of dispensing both high and low viscosity material from a cartridge, and are also unreliable. Therefore, there is a need for a reliable robot-mounted fluid dispensing system that has the ability to dispense high or low viscosity material from a prefilled cartridge. Further, there is a need for a fluid dispensing system that can automatically open or close a space to receive a replaceable fluid cartridge in order to reduce extensive handling.

SUMMARY

The foregoing needs are met, to a great extent, by implementations of the robot-mounted motorized fluid dispensing apparatus according to this disclosure. In accordance with one implementation, a fluid dispensing apparatus, or dispenser, is configured to dispense fluid from a fluid cartridge having an internal plunger movable between a proximal end of the cartridge and a distal end of the cartridge. The dispenser includes a housing frame configured to be releasably coupled to a robot, a cartridge holder defining a cartridge holding space configured to receive the fluid cartridge and contain the cartridge under pressure, and a cartridge actuator assembly including a linear actuator and a piston rod configured to urge the plunger from the proximal end of the fluid cartridge to the distal end of the fluid cartridge for discharging fluid from the distal end of the cartridge. The dispenser further includes a dispense section having a dispense valve assembly. An end effector assembly may be coupled to the dispense section and configured to dispense the fluid to an application site in a precise and controlled manner.

In some implementations, the dispenser may further include a fluid mating member configured to releasably couple the end effector to the dispense section. The cartridge holder may include a first clamshell member fixed to the housing and a second clamshell member pivotably connected to the first clamshell member such that the second clamshell member is pivotable between an open position for loading or unloading the cartridge and a closed position for securing the cartridge in place, as well as for supporting and containing the cartridge under pressure.

In some implementations, a locking member may be configured to secure the cartridge holder in the closed position by clamping the first and second clamshell members together. The locking member may be connected to a locking actuator fixed to the housing frame and configured to move in and out of locking engagement with the first and second clamshell members. The locking actuator includes a pneumatic driver and a reciprocating rod coupled to the locking member, or other types of devices.

In some implementations, the cartridge actuator assembly may further include a motor, a drive rod coupled to the motor, such as a servomotor, and arranged substantially parallel to the piston rod, and an actuator linkage member configured to couple the drive rod to the piston rod. The piston rod may include a piston head configured to correspondingly interface with a proximal surface of the plunger of the cartridge for urging the plunger through the fluid cartridge during a dispensing operation. Moreover, the piston rod may define an internal piston passageway and the piston head defines an internal piston head passageway, such that the piston passageway and the piston head passageway are in fluid communication with each other. Additionally, the piston head may further include a fluid outlet defining at least one vent hole in fluid communication with the piston head passageway for providing ventilation so as to prevent a vacuum between the piston head and the plunger in order to relieve pressure between the piston and the plunger during piston insertion into the cartridge, and also to relieve vacuum pressure between the piston and the plunger during piston withdrawal from the cartridge. Furthermore, air pressure may be conveyed through this passage to aid in separation of the piston from the plunger and the cartridge during piston withdrawal therefrom.

In some implementations, the housing frame may also include at least one robot mounting plate configured to connect to a robotic arm of the robot for precisely controlling the location of dispensing.

In some implementations, the dispense section may further include a discharge passage configured to receive fluid discharged from the cartridge during a dispensing operation. The dispense section may also include a discharge outlet in fluid communication with the discharge passage, and a dispense valve actuator configured to move the dispense valve assembly between an open position in which fluid flows through the discharge outlet and a closed position in which no fluid flows through the discharge outlet. The dispense valve assembly may include a valve rod and a snuff back mechanism, or other type of valve.

In some implementations, the snuff back mechanism may include a snuff back element provided within the snuff back passage in fluid communication with both the discharge passage and the discharge outlet. The snuff back element may be configured to reciprocate within the snuff back passage by moving forward and backward in response to the dispense valve actuator between a respective flow position and a snuff back position. The snuff back element may define a thick region and a directly adjacent thin region, such that the thick region sealingly abuts a resilient valve seal provided at the intersection of the snuff back passage and the discharge outlet when the dispense valve is in the closed position in order to block fluid flow between the discharge passage and the discharge outlet, and the thin region does not sealingly abut the valve seal for allowing fluid to flow past the snuff back element toward the discharge outlet when dispense valve is in the open position.

In some implementations, the end effector assembly may include a dispense nozzle. In other implementations, the end effector assembly may include an applicator brush.

In some implementations, a cartridge ejector may be configured to eject the cartridge from the holding space. The cartridge ejector may include a pneumatic actuator, or other type of mechanism, defining a cylindrical ejector housing and a pneumatic ejector piston mounted for reciprocation within the ejector housing, the ejector piston being coupled to an ejector element that is configured to engage and lift at least the distal end of the cartridge. In other implementations, other types of ejector devices and methods may be used.

According to another implementation of the disclosure, a fluid dispensing system for dispensing fluid from a cartridge may include a robot having a robotic arm, a housing frame mounted to the robotic arm of the robot, a cartridge holder secured to the housing frame and configured to receive the fluid cartridge, a cartridge actuator assembly comprising a piston rod and a linear actuator, such as a servomotor, configured to move the piston rod in a reciprocating manner to urge an internal plunger of the cartridge toward a dispensing end of the cartridge. In other implementations, the cartridge actuator assembly may comprise other types of linear actuators, including an air cylinder, a hydraulic cylinder, an electric cylinder, a force tube, a ball screw, and a mechanical screw drive, among others. A dispense section is in fluid communication with the dispensing end of the fluid cartridge and having a dispense valve assembly and a snuff back mechanism. An end effector assembly may be coupled to the dispense section by a quick change adapter.

In some implementations, the snuff back mechanism includes a snuff back element having a thick region and a directly adjacent thin region. The thick region sealingly abuts a resilient valve seal provided in the dispense section in order to block fluid flow from being dispensed to the end effector, and the thin region does not sealingly abut the valve seal when the dispense valve is in the open position for allowing fluid to flow past the snuff back element. The dispense valve assembly and the snuff back mechanism may be configured to be simultaneously actuated to a flow position during the dispensing operation. In other implementations, the dispense valve assembly may be configured to perform a snuff back operation.

Various advantages, features and functions of the present disclosure will become readily apparent and better understood in view of the following description and accompanying drawings. The following description is not intended to limit the scope of the present disclosure, but instead merely details exemplary aspects for ease of understanding.

DETAILED DESCRIPTION

Figure 1:
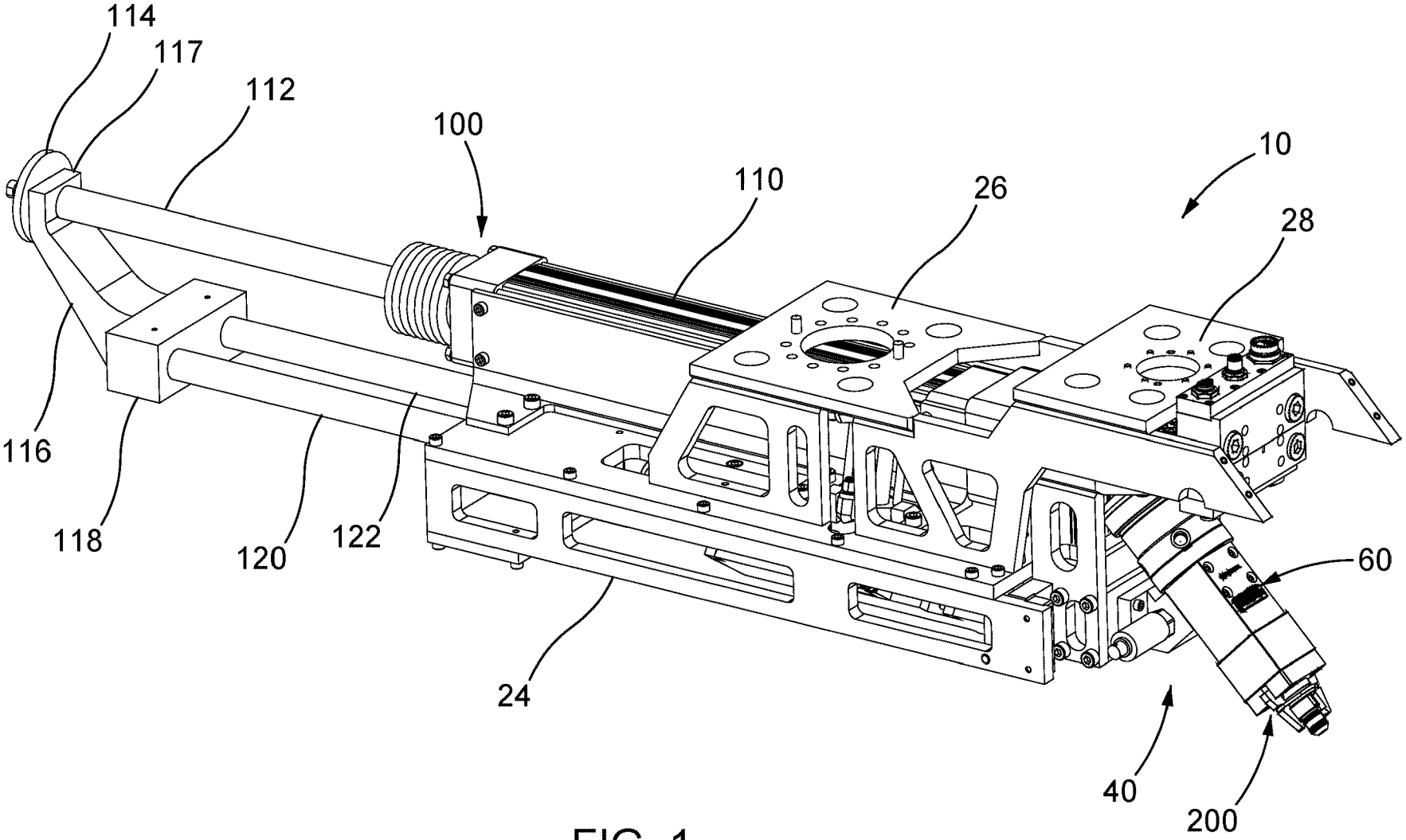
FIG. 1 is a top perspective view of a dispensing apparatus in accordance with the disclosure.
Figure 2:
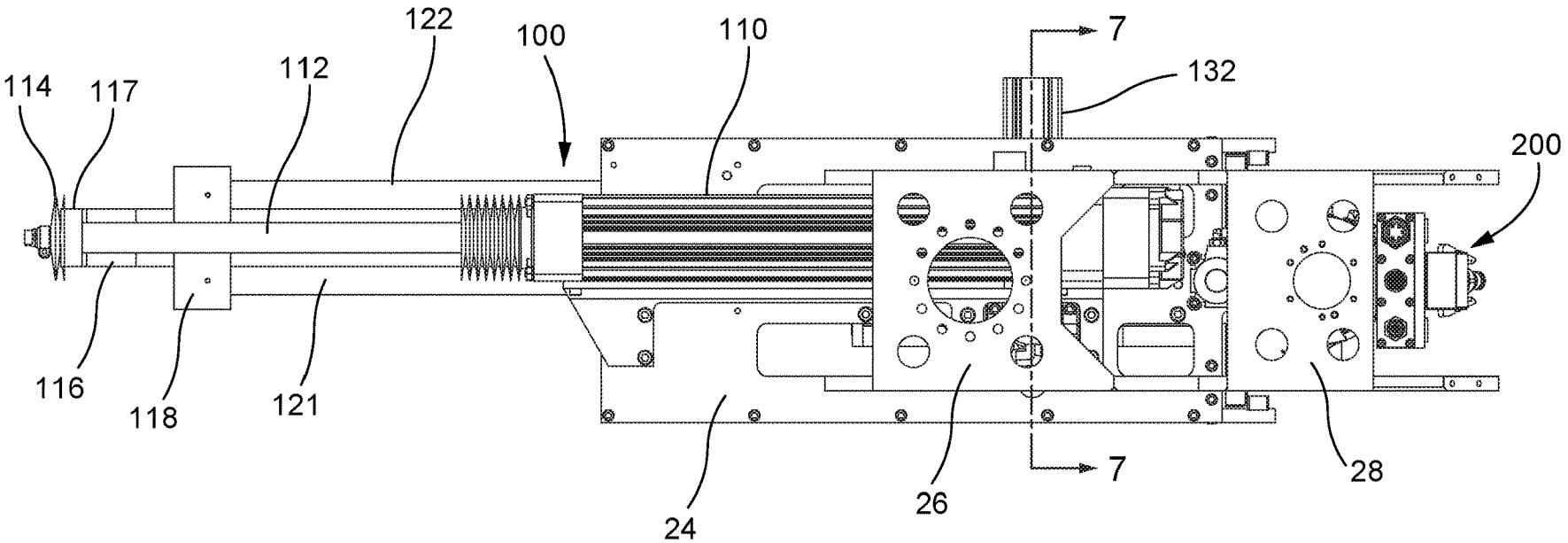
FIG. 2 is a top plan view of the dispensing apparatus shown in FIG. 1.
Figure 3:
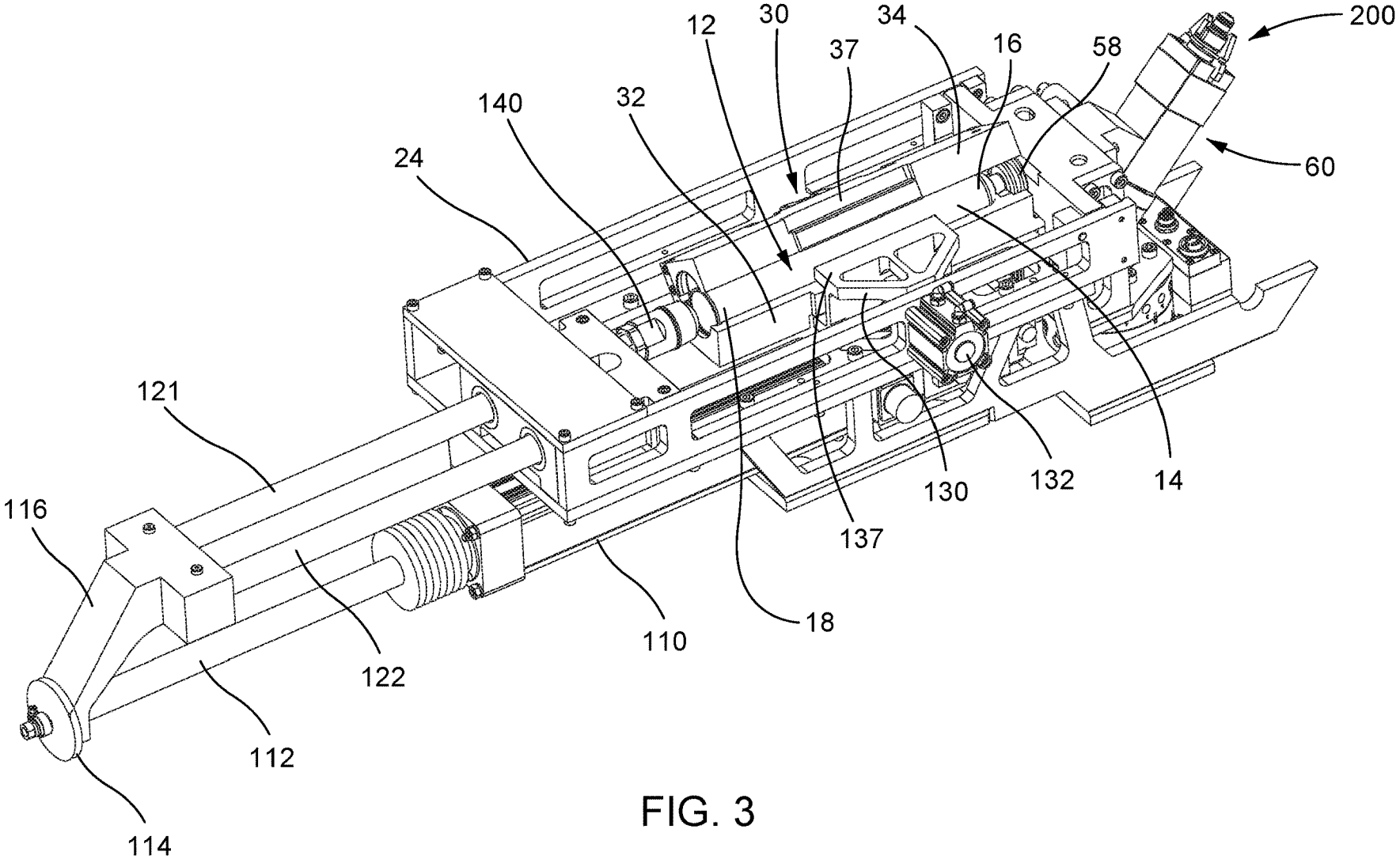
FIG. 3 is a bottom perspective view of the dispensing apparatus shown in FIG. 1, illustrating a fluid cartridge in place within a cartridge holder, and a clamshell member in a partially open position.
Figure 4:
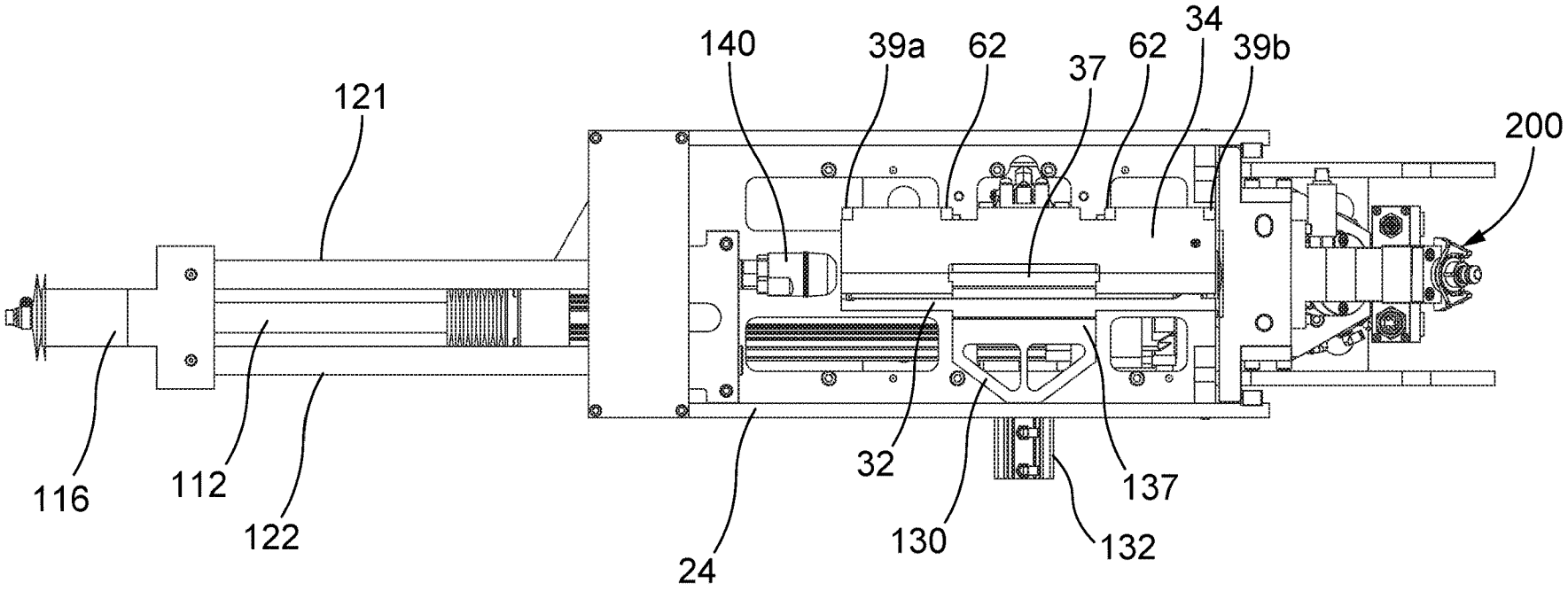
FIG. 4 is a bottom plan view of the dispensing apparatus shown in FIG. 1.
Figure 5:
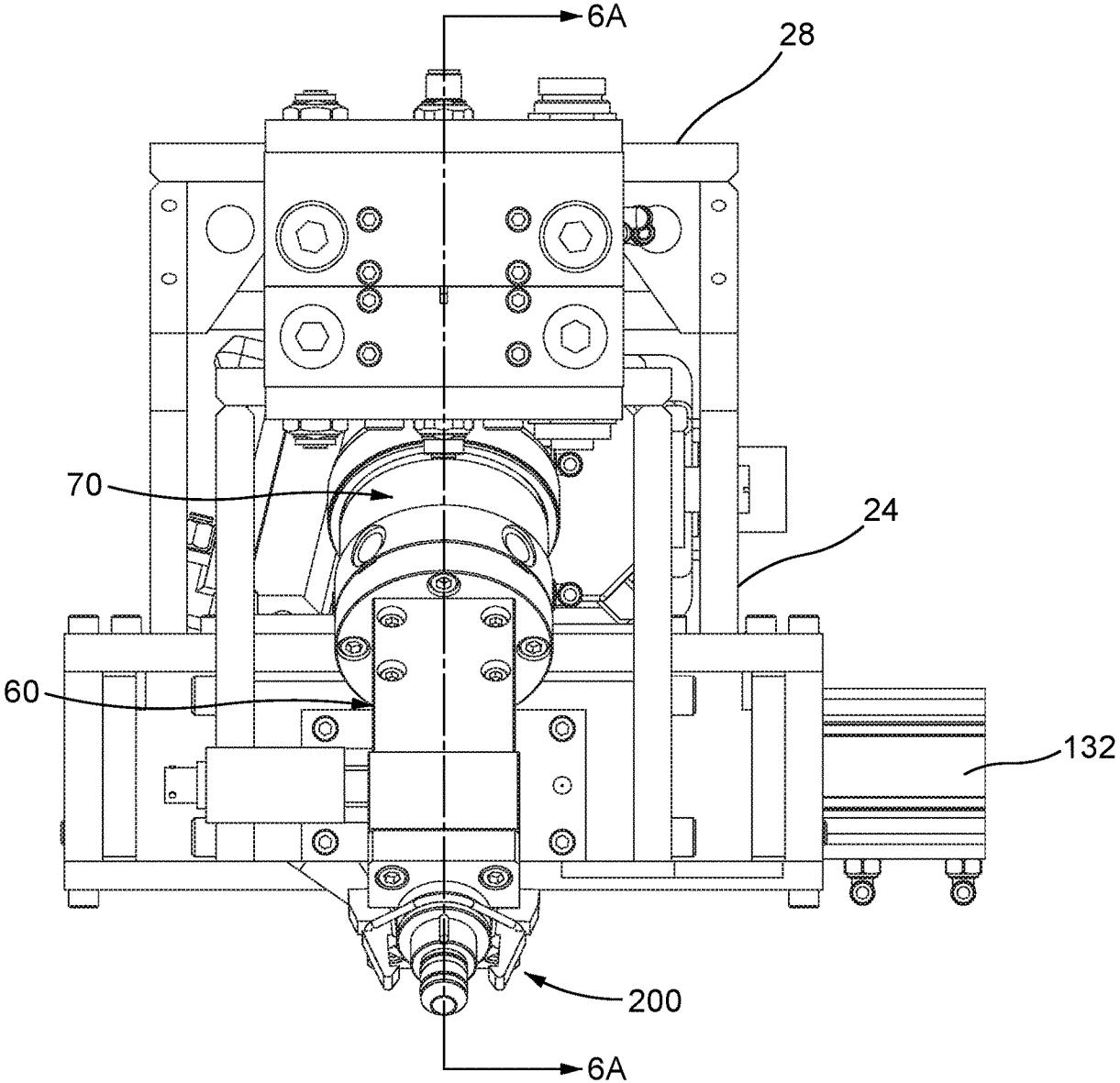
FIG. 5 is a front plan view of the dispensing apparatus shown in FIG. 1.

FIGS. 1-7 illustrate a robot-mountable cartridge type dispensing apparatus 10, also referred to as a dispenser 10, for dispensing from a cartridge various types of fluids, including but not limited to polysulfides, urethanes, epoxies, adhesives, and silicones. In the implementation shown, the dispensing apparatus 10 utilizes a fluid cartridge 12 including a cartridge body 14 having a distal end 16 adapted to discharge fluid, a proximal end 18 adapted to receive a piston rod 120, and a fluid space 20 extending between the distal and proximal ends 16, 18. A plunger 22 is positioned in the fluid space 20 and is movable from the proximal end 18 toward the distal end 16 under a force applied by the piston rod 120. The dispensing apparatus 10 also comprises a housing frame 24 having a first robot mounting plate 26 and a second robot mounting plate 28. The robot mounting plates 24, 26 are each configured to removably secure the dispenser 10 to a robot, such as a robotic arm configured to control movement of the dispenser to desired locations during the dispensing operation for precise and controlled placement of fluid at an application site.

The dispensing apparatus 10 also comprises a cartridge holder 30 including a first clamshell member 32 and a second clamshell member 34. The cartridge holder 30 is configured to receive the cartridge 12 in a cartridge holding space 36. At least one of the clamshell members 32, 34 is movable toward and away from the other of the clamshell members 32, 34 for allowing the cartridge 12 to be received in and removed from the holding space 36. The dispenser 10 may be sized to accommodate a variety of cartridge sizes, such as a 6 oz. capacity cartridge or a 12 oz. capacity cartridge.

The dispensing apparatus 10 further includes a dispense section 40 having a discharge passage 42 and a discharge outlet 44. A fluid mating member 200 may be coupled to the discharge outlet 44 for further directing the discharged fluid from the dispensing apparatus 10 to an end effector assembly 300, such as dispensing nozzle or an applicator brush. The fluid mating member 200 serves as an adapter to connect the end effector assembly 300 to the dispense section 40 in fluid communication. The discharge passage 42 communicates with a suitable fluid supply in the cartridge.

Figure 6A:
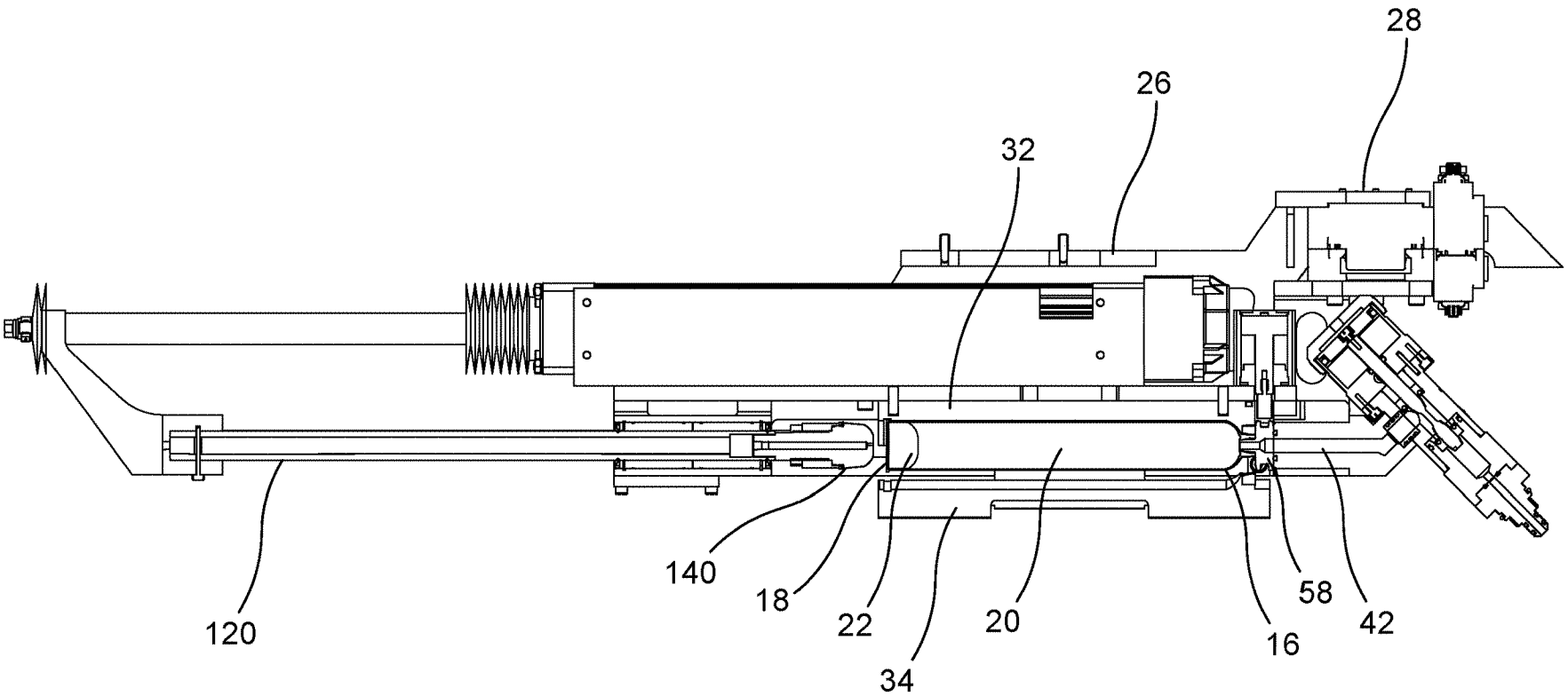
FIG. 6A is a cross-sectional side elevation view of the dispensing apparatus taken along line 6A-6A of FIG. 5.
Figure 6B:
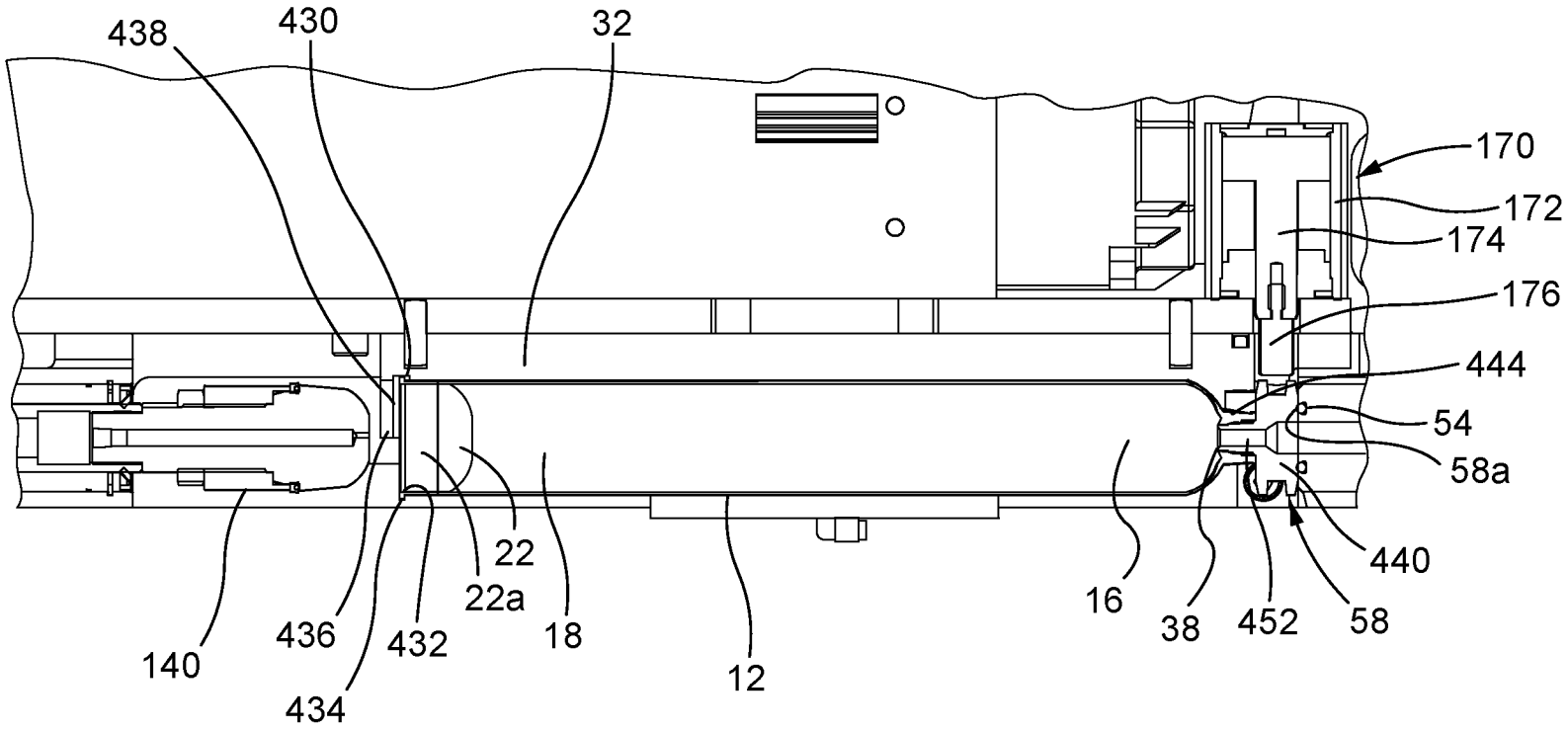
FIG. 6B is an enlarged view of a portion of the cross-sectional view shown in FIG. 6A.

As shown in FIGS. 6A and 6B, the discharge passage 42 communicates with the cartridge holding space 36 such that the discharge passage 42 receives fluid from a distal outlet passage 38 of the fluid cartridge 12 when the fluid cartridge 12 is received between the first and second clamshell members 32, 34. Thus, the distal outlet passage 38 serves as the supply passage to the dispense section 40. In some implementations, a cartridge mating member 440 may be coupled to the distal outlet passage 38, as will later be described in greater detail. A first seal 54 is located in surrounding relation to an inlet 56 of the discharge passage 42. This seal 54 may be a face seal that engages a distal tip element 58 of the fluid cartridge 12. Specifically, the seal 54 abuts against an outer surface 58*a* of the distal tip element 58 that faces in the same direction as the flow of fluid from the cartridge 12. The fluid is further directed to the discharge outlet 44 during a dispensing operation.

Turning back to FIGS. 3 and 4, the first clamshell member 32 is fixed to the housing frame 24 of the dispensing apparatus 10, and the second clamshell member 34 is pivotably movable relative to the stationary first clamshell member 32. A pair of hinges 39*a*, 39*b* provided on a side of the cartridge holder 30 pivotably connect the second clamshell member 34 to the first clamshell member 32, such that the second clamshell member 34 may be pivoted between an open position and a closed position. The open position allows for loading and unloading of the cartridge 12, and the closed position allows for dispensing fluid from the cartridge 12.

The dispensing apparatus 10 further includes a locking member 130 configured to secure the cartridge holder 30 in the closed position by clamping the first and second clamshells together. The locking member 130 is provided proximate to the side of the cartridge holder 30 opposite the hinges 39*a*, 39*b*, and is movably connected to a locking actuator 132. The locking actuator 132 is fixed to a side of the housing frame 24 and is configured move the locking member 130 in and out of locking engagement with the first and second clamshells 32, 34. The locking actuator 132 may comprise a pneumatic driver and a reciprocating rod 134 that is coupled to the locking member 130.

Figure 7:
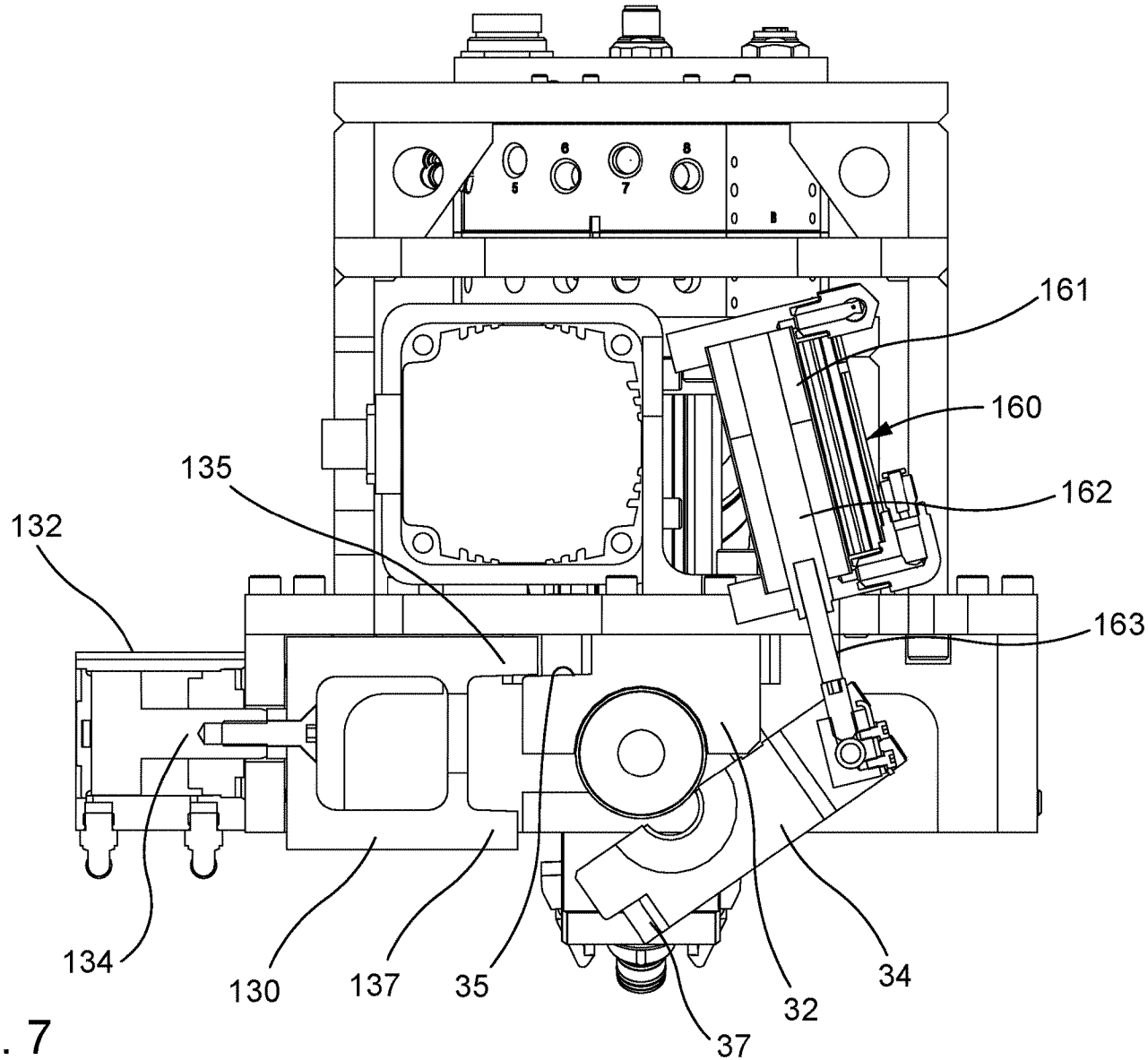
FIG. 7 is a rear cross-sectional view of the dispensing apparatus taken along line 7-7 of FIG. 2.

As shown in FIG. 7, the locking member 130 may comprise a first flange member 135 and an oppositely spaced apart second flange member 137 that are configured to mate with a corresponding first shoulder 35 formed on the first clamshell member 32 and a second shoulder 37 formed on the second clamshell member 34, respectively. The movable clamshell half 34 is actuated between an open position and a closed position by a clamshell actuator 160. The clamshell actuator 160 may comprise a pneumatic cylinder 161 having a reciprocating rod 162 coupled to the pivotable clam shell half 34 via a connector rod 163, or by other means.

Figure 8:
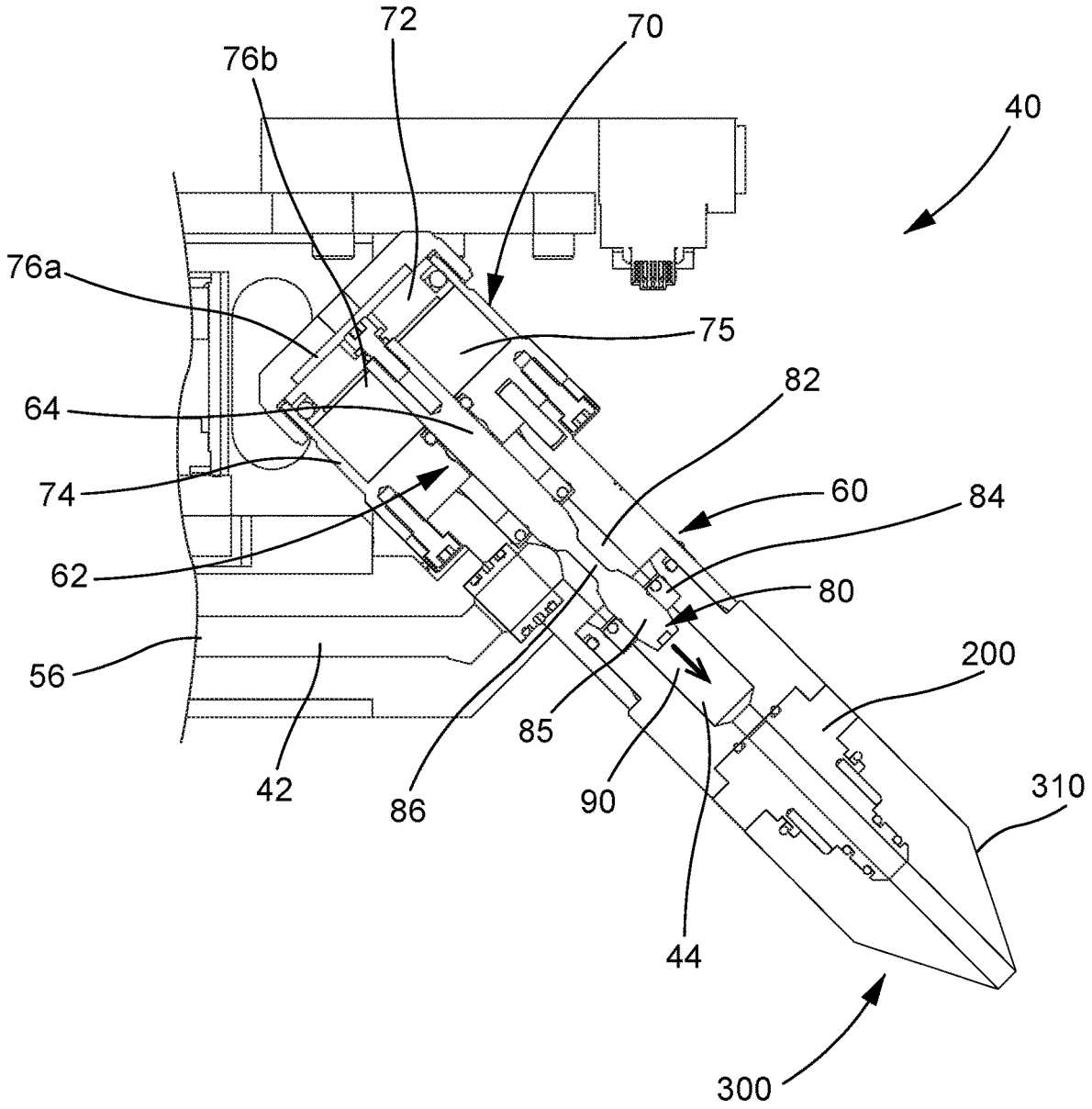
FIG. 8 is a cross-sectional view of a dispense section of the dispensing apparatus in accordance with the disclosure.

Referring to FIG. 8, the dispense section 40 further includes a dispense valve assembly 60 coupled with a dispense valve actuator 70 for moving a dispense valve 62 between an open position and a closed position. This facilitates on/off control of dispensing fluid from the cartridge 12 through the discharge passage 42. Additionally, the dispense valve assembly 60 may include a snuff back mechanism, as will be further discussed below. It should be appreciated that other types of valves may also be used, including those without a snuff-back mechanism. Furthermore, in other implementations, the dispense valve may be configured to operate a snuff back operation. The dispense valve assembly 60 and/or any of its elements may be made of any suitable material including steel, hardened steel or any other suitable substance, such as plastic for minimizing cured material adhesion. Accordingly, the dispense valve assembly 60 may comprise a snuff back element 80 and a dispense valve 62 having a valve rod 64.

The snuff back mechanism comprises a snuff back element 80 having an hourglass shape that is slidably mounted within a snuff back passage 82 located between the discharge passage 42 and the discharge outlet 44. More particularly, the snuff back passage 82 intersects with, and therefore, fluidly communicates with the discharge passage 42. Further, the snuff back passage 82 aligns with, and therefore, fluidly communicates with the discharge outlet 44. The snuff back element 80 is configured to reciprocate within the snuff back passage 82 by moving forward and backward in response to the dispense valve actuator 70, such that the snuff back element 80 is movable between a respective flow position and a snuff back position.

Referring again to FIGS. 1-4, a cartridge actuator assembly 100 is configured to dispense fluid from the cartridge 12. The cartridge actuator assembly 100 includes a motor 110, a drive rod 112 coupled to the motor, a piston rod 120, and an actuator linkage member 116 configured to couple the drive rod 112 to the piston rod 120. In one implementation, the motor 110 is a servomotor configured to linearly move the drive rod 112 in a reciprocating manner. In other implementations, other types of motors may be used, including a rotary motor or a linear motor. Use of such a servomotor has been found to improve reliability of the actuator assembly since it is capable of producing greater thrust than conventional actuator assemblies, while also providing a positive displacement of the fluid material. For instance, the servomotor may generate a force on the plunger that results in pressures up to 400 psi or higher for dispensing highly viscous fluids. In another implementation, movement of the piston rod 120 may be driven by a pneumatic actuator, a hydraulic actuator, or other suitable device.

A first end 117 of the actuator linkage member 116 is secured to an end of the drive rod 112 by a rod fastener 114, such as a threaded nut. A second end 118 of the actuator linkage member 116 is attached to a first end of the piston rod 120. Accordingly, reciprocating movement of the drive rod 112 caused by the servomotor likewise results in reciprocating movement of the piston rod 120. The piston rod 120 extends from the actuator linkage member in a direction toward the cartridge holding space 36 of the cartridge holder 30, such that the piston rod 120 and the cartridge are coaxially aligned when the cartridge is placed within the cartridge holder 30. Moreover, the piston rod 120 and the drive rod are arranged substantially parallel to each other. At least one auxiliary piston rod 122 may also be connected to the actuator linkage member 116 and configured to move along with the piston rod 120 and the drive rod 112 for providing additional support and stability. Such an auxiliary piston rod 122 is also arranged substantially parallel to the piston rod 120 and the drive rod 112. Both the piston rod 120 and the auxiliary piston rod 122 may be rigidly fixed to the actuator linkage member 116, or removably attached via fasteners such as screws and bolts, among others. The piston rod 120 includes a piston head 140 configured to matingly engage the plunger 22 of the cartridge in order to move the plunger 22 through the fluid cartridge 12 during a dispense operation, as will later be described below.

Referring to FIG. 8, the dispense valve 62 includes a valve rod 64 that is movable between the closed position shown, in which no fluid may flow from the fluid cartridge 12 through the discharge passage 42 to the discharge outlet 44, and an open position in which fluid is allowed to flow from the fluid cartridge through the discharge passage to the discharge outlet 44. The dispense valve 62 may be operated in a reciprocating manner between the open and closed positions by operating the dispense valve actuator 70 with pressurized air. In other implementations, the dispense valve 62 may be a rotary ball valve, a ball and seat valve, a pinch tube, or other types on/off control valves.

Still referring to FIG. 8, the dispense valve actuator comprises a pneumatic valve piston 72 housed within a valve actuator housing 74, and more specifically, within a cylindrical bore 75. A proximal end of the valve rod 64 is connected to the pneumatic valve piston 72, and a distal end of the valve rod 64 is connected to the snuff back element 80. The bore 75 receives pressurized air on one side 76*a* of the piston 72 for moving both the valve rod 64 and the snuff back element 80 simultaneously in the direction of the arrow 90, thus moving the dispense valve 62 to an open position. The bore 75 also receives pressurized air on the opposite side 76*b* of the piston 72 to simultaneously move the valve rod 64 and the snuff back element 80 in the opposite direction, thus moving the dispense valve 62 to the closed position shown.

During a flow or dispensing condition when the dispense valve 62 is opened by the dispense valve actuator 70, the snuff back element 80 is simultaneously actuated to a flow position by moving toward the discharge outlet 44. The hour glass shape of the snuff back element 80 defines a thick, or wide, region 85 and a directly adjacent thin, or narrow, region 86. The thick region 85 sealingly abuts a resilient valve seal 84, such as an elastomeric O-ring, provided at the intersection of the snuff back passage 82 and the discharge outlet 44 when the dispense valve 62 is in the closed position. Thus, fluid communication between the discharge passage and the discharge outlet 44 is prevented when the dispense valve 62 is closed. Prior to opening the dispense valve 62, the dispense valve actuator 70 and the piston 72 may travel forward to create a pre-determined pre-pressure value within the material in order to assist in obtaining the desired flow rate at the beginning of a dispense cycle.

When the dispense valve actuator 70 moves the dispense valve to the open position, the thin region 86 of the snuff back element 80 is positioned concentrically within the valve seal 84 in the flow position. The thin region 86 of the snuff back element 80 does not sealingly abut the valve seal 84, and thus fluid is allowed to flow past the snuff back element 80 toward the discharge outlet 44 when dispense valve 62 is opened. Further, the thick region 85 of the snuff back element 80 moves into the discharge outlet 44 when the dispense valve is in the open position. The thick region 85 of the snuff back element 80 has a smaller diameter than the diameter of the discharge outlet 44, so that fluid flow through the discharge outlet 44 is not blocked or impeded by the thick region 85 of the snuff back element 80 when in the flow position.

In the dispense condition, the plunger 22 of the fluid cartridge 12 is moved from the proximal end 18 to the distal end 16 of the cartridge body 14 by a force applied by the piston rod 120 of the cartridge actuator assembly 100 against the proximal end 22*a* of the plunger 22. This forces the fluid in the fluid space 20 through the outlet passage 50 of the cartridge 12 and into the discharge passage 42, through the dispense valve assembly 60, past the snuff back element 80, and finally out of the discharge outlet 44.

Figure 9:
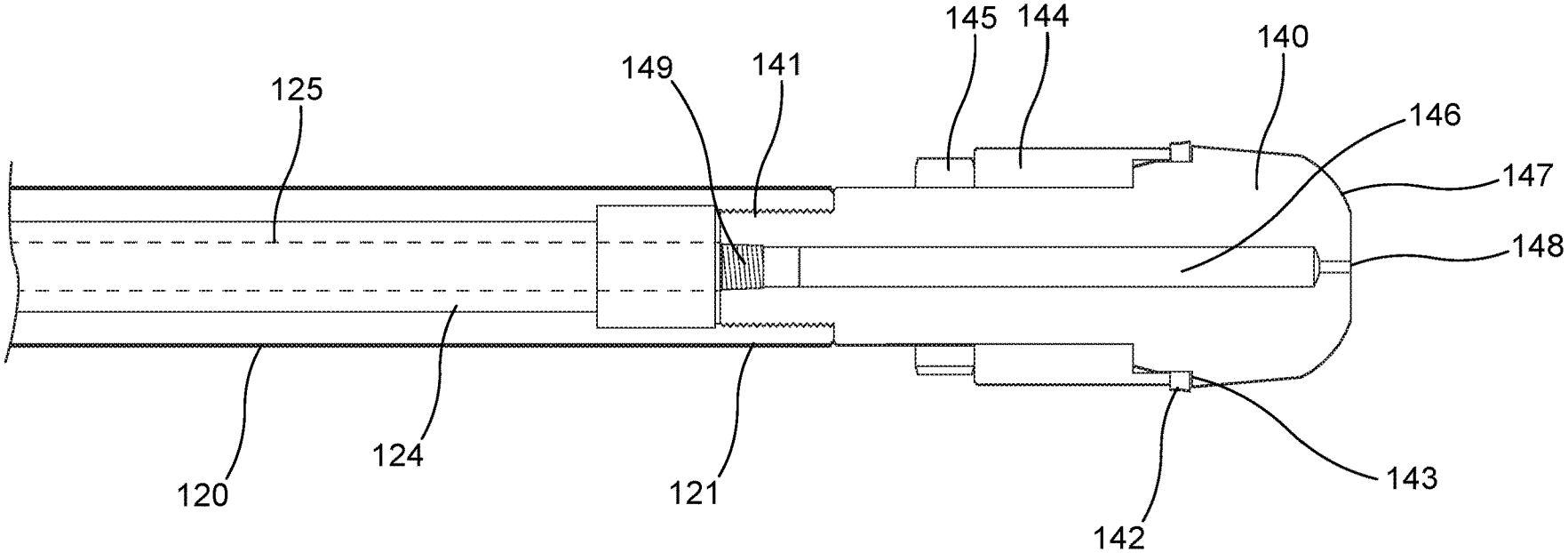
FIG. 9 is a cross-sectional view of a piston rod and piston head of a cartridge actuator assembly in accordance with the disclosure.

As illustrated in FIG. 9, a piston head 140 is removably attached to the piston rod 120. In one implementation, a distal end 141 of the piston head 140 is threadedly engaged to a distal end 121 of the piston rod 120. The piston head 140 may be configured to accommodate fluid cartridges 12 of different lengths, different diameters, and different fluid volume capacities. The piston head 140 may further be designed to accommodate for differences that occur due to resulting tolerance variations of the cartridge 12 caused during manufacturing. A resilient piston seal 142 is provided on the piston head 140 between a shoulder 143 of the piston head 140 and an annular seal retainer 144. The seal 142 and seal retainer 144 are secured in place by a fastening member 145, such a threaded nut. The seal 142 prevents fluid leakage between the piston head 140 and the cartridge 12 during the dispensing operation since the integrity of the seal 142 is maintained even when the tolerances of the outer diameter and the inner diameter of the cartridge vary.

The piston rod 120 defines an internal piston passageway 124 that is in fluid communication with an internal piston head passageway 146. A proximal end 147 of the piston head 140 includes a vent outlet defining at least one vent hole 148 that is in fluid communication with the piston head passageway 146. The proximal end 147 of the piston head 140 is also configured to matingly interface with the proximal end 22*a* of the plunger 22 of the cartridge in order to maintain the integrity of the plunger 22 during dispensing by preventing it from rolling over or changing shape under pressure. Maintaining the integrity of the plunger 22 further helps prevent fluid leakage between the plunger 22 and the interior walls of the cartridge 12.

In some instances when the piston head 140 enters the cartridge 12 and moves the plunger 22 therethrough to push the fluid out of the cartridge 12, it may be difficult to then move the piston head 140 proximally back out of the cartridge 12. This difficulty may be caused by a vacuum formed between the piston head 140 and the plunger 22 as a result of moving the piston rod 120 distally without having any fluid return to the cartridge 12. The at least one vent hole 148 provides ventilation in order to prevent vacuum pressure when the piston head 140 pushes the plunger 22 during the dispense operation.

Figure 10:
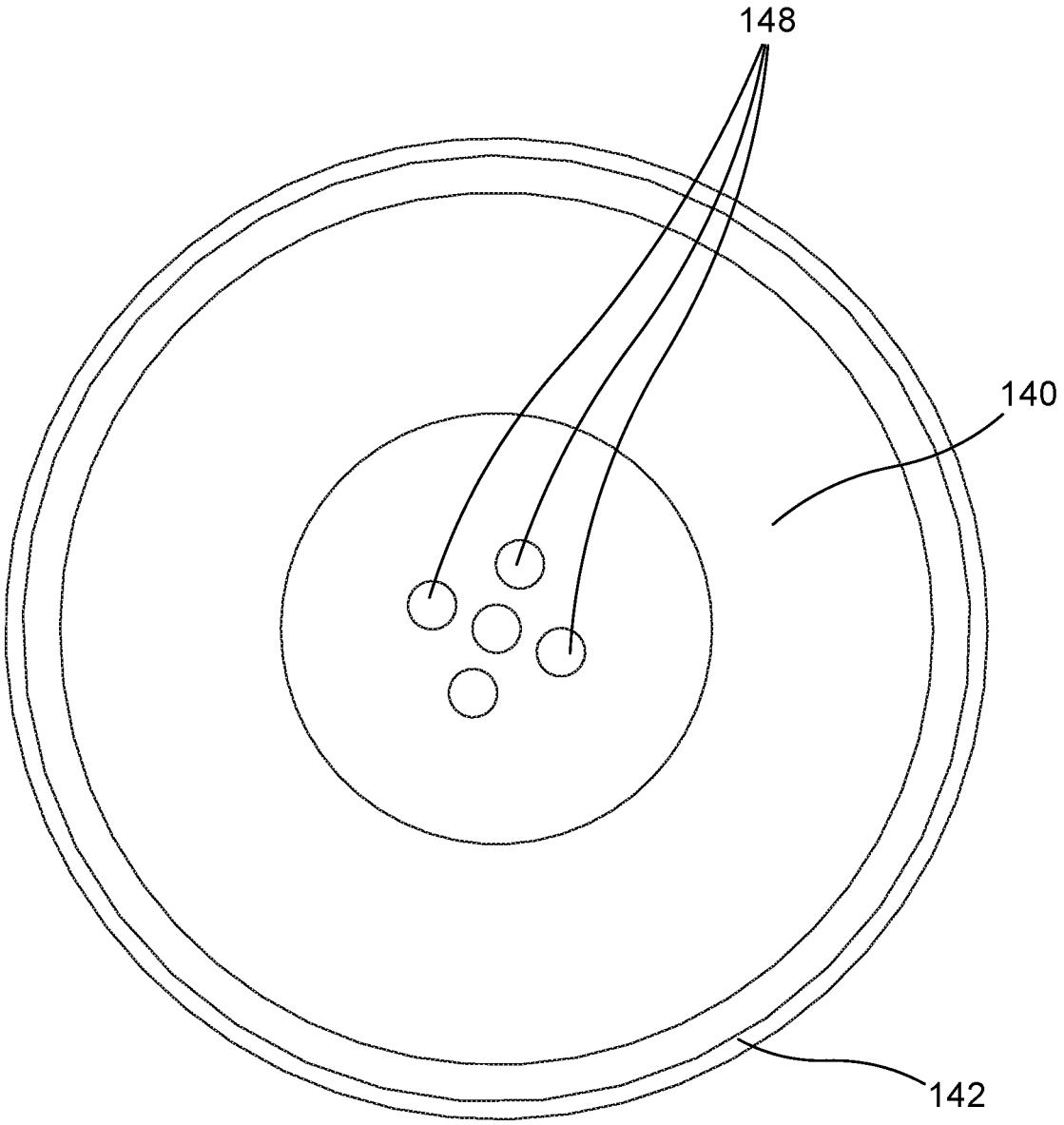
FIG. 10 is a front view of the piston head shown in FIG. 9.

In the implementation shown in FIG. 10, for instance, the piston head 140 includes an arrangement of a plurality of vent holes 148, such as five holes, which help to relieve pressure formed when the piston head 140 enters the cartridge and engages the plunger 22. The presence of the at least one vent hole 148 allows for a flow of air into the piston head passageway 146 once the piston head 140 enters the cartridge to urge the plunger 22 during dispensing. Moreover, the presence of multiple vent holes 148 allows for a flow of air even if some of the vent holes become clogged with leaked fluid material. In one implementation, each of the vent holes 148 may be the same size. In another implementation, the vent holes 148 may be different sizes. The vent holes 148 may further be arranged in any number of patterns and may be any number of sizes depending on the size of the cartridge.

Further, since the inner diameter and outer diameter of each cartridge may change depending on the temperature and other tolerances held during manufacturing, it is necessary to maintain the integrity of the cartridge during the dispensing operation when the pressure inside the cartridge is increased, in order to avoid breaking the cartridge and having fluid material flow uncontained throughout the dispenser. Furthermore, the cartridge is captured and retained in position so that it can be pressurized. Accordingly, when the piston head 140 matingly interfaces with the plunger 22, the air trapped therebetween flows through the at least one vent hole 148 and into the piston head passageway 146 for relieving vacuum pressure within the cartridge. As previously described, the piston head 140 may be threadedly attached to the piston rod 120 so that it can easily be removed and cleaned or replaced in the event of fluid leakage.

In one implementation, the cartridge 12 may contain a two-part curing material, such as a polysulfide two-component premixed and frozen material. The distal end of the piston head 140 may be configured to attach to an internal safety hose 125, such as a vinyl hose, extending through the piston rod passageway 124 of the piston rod 120. The distal end of the piston head 140 includes internal threads 141 for threadedly engaging a push fitting to connect to the hose 125. Thus, in the event that leaked fluid material enters into the piston head passageway 146 through the vent holes 148, the leaked fluid can be blown out before it cures. Moreover, the internal safety hose 125 prevents leaked fluid material from adhering to, gumming up, or otherwise clogging the interior passageway 124 of the piston rod 120. In one implementation, the internal hose 125 extends through the piston rod 120 and terminates in a pig tail end so that an operator can connect to the pig tail end and blow out material from the hose. Without the safety hose, any leaked fluid material that enters the piston head passageway and/or the piston rod passageway could harden and block airflow, thus rendering the components unusable for venting air.

When the plunger 22 has reached the end of its travel during a dispensing operation, or otherwise when a dispense cycle or operation is complete, the dispense valve 60 is moved by the dispense valve actuator 70 to the closed position as shown in FIG. 8. This action simultaneously moves the snuff back element 80 from the flow position to the snuff back position also shown, by introducing pressurized air on the top of the pneumatic valve piston 72 and exhausting air from below the piston. This snuff back action draws fluid back from the discharge outlet 44, including any nozzle 310 or other dispensing element coupled to the discharge outlet 44, in order to prevent drooling of fluid from the dispensing apparatus 10 after the dispense cycle or operation is complete. The fluid is drawn from the discharge outlet 44 and into the snuff back passage 82 due to suction caused by vacuum pressure created when the thick region 85 of the snuff back element 80 retracts from the discharge outlet 44 and into sealing abutment with the valve seal 84.

Once the plunger 22 is urged to the distal end 16 of the cartridge 12 by the piston head 140 at the end of the dispense cycle, the piston head 140 can be removed from the cartridge by operating the servomotor in the reverse direction to retract the piston rod 120. The dispensed cartridge 12 may then be removed from the cartridge holder 30, and a new cartridge may be placed in the dispensing apparatus 10. Turning again to FIG. 6B, the dispenser may include a cartridge ejector 170 configured to eject the fluid cartridge 12 at the end of the dispense cycle and/or when the fluid cartridge 12 is empty and in need of replacement. The cartridge ejector 170 may be used to eject the cartridge 12 from the holding space 36 after the clam shells 32, 34 of the cartridge holder 30 have been unclamped by actuating the locking member 130 to the unlocked position as previously described above. The cartridge ejector 170 comprises a pneumatic actuator 172 defining a cylindrical ejector housing and a pneumatic ejector piston 174 mounted for reciprocation within the ejector housing. The ejector piston 174 is coupled to an ejector element 176 that is configured to engage and lift at least the distal tip element 58 and the distal end 16 of the cartridge 12. Once ejected, the cartridge 12 may be grasped either manually or in an automated manner, such as by a robotic grasping mechanism. In another implementation, the cartridge ejector 170 may comprise a lever configured to eject a cartridge.

One implementation of the cartridge may include a flange 430 defining a flange stop surface 432 configured to retain the cartridge 12 within the dispenser 10. When the cartridge is placed within the cartridge holder, the flange stop surface 432 abuts against a distal stop surface 434 defined by the clam shell halves 32 to limit the travel of the cartridge 12 in a distal direction. The flange 430 is located in a flange groove 438 defined by the clam shell halves 32, 34. A proximal stop surface 436 defined by the clam shell halves 32 will engage the flange 430 to limit the axial travel of the cartridge in the proximate direction. As such, the flange groove 438 is defined in part by the distal stop surface 434 and the proximal stop surface 436.

The cartridge 12 connects with a cartridge mating member 440 having a projection 442. A projection receiver 444 located in the distal end 16 of the cartridge 12 fits over the projection 442 to attach the cartridge 12 to the cartridge mating member 440 in a sealed manner. The projection receiver 444 on the cartridge 12 can slip over the projection 442 when the cartridge 12 is pushed on to the cartridge mating member 440. The projection receiver 444 flexes to fit over the projection 442. The flexure of the projection receiver 444 may be limited by a retaining ring 446. A space 448 between the retaining ring 446 and the projection receiver 444 indicates the amount the projection receiver 444 may flex before it is stopped by the retaining ring 446. The projection 442 is used to connect the cartridge 12 to the dispenser 10 and provide fluid communication between the cartridge 12 and the discharge passage in a sealed manner.

Figure 6C:
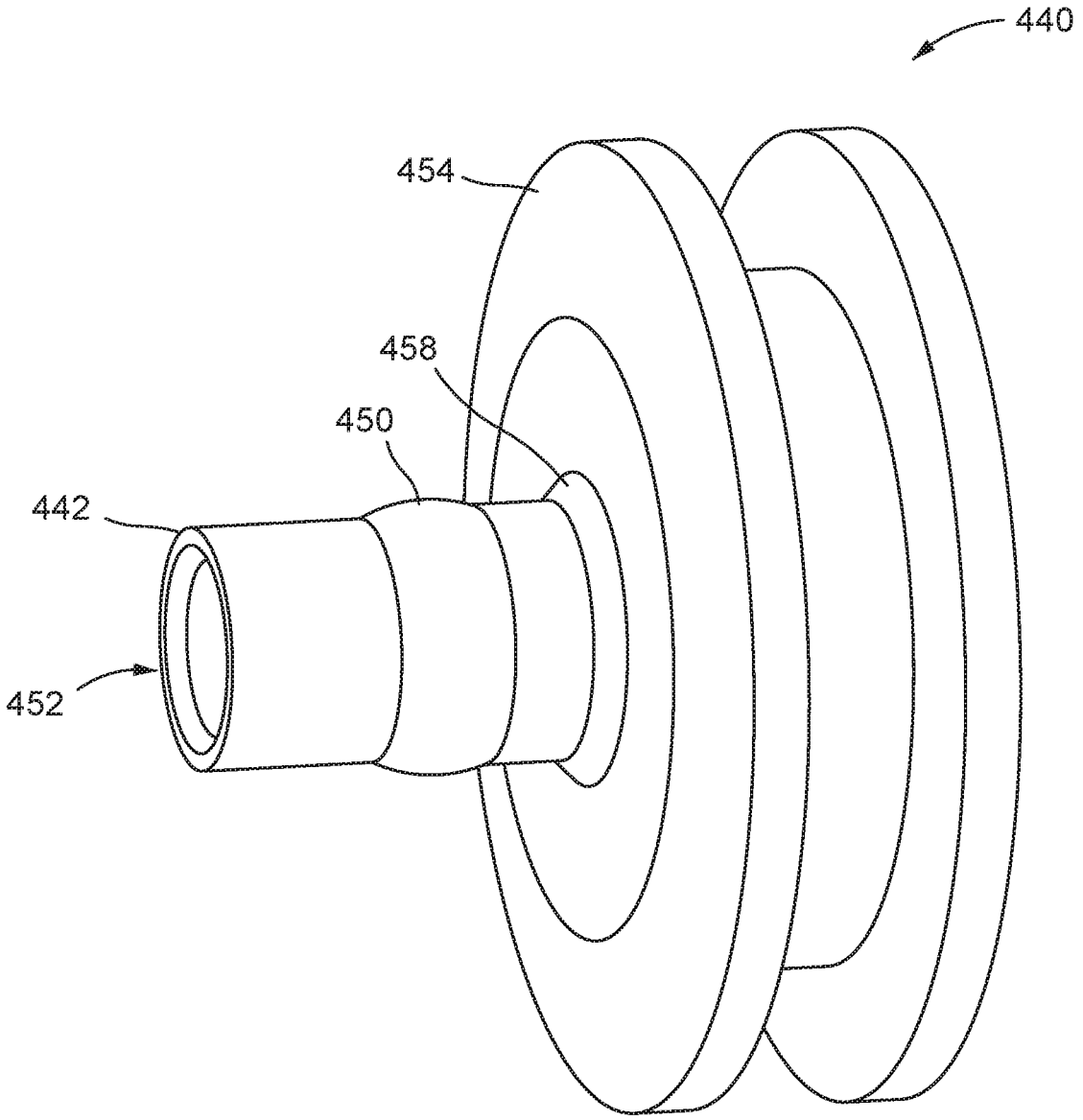
FIG. 6C is an isometric view of a cartridge mating member in accordance with the disclosure.

As shown in FIG. 6C, the projection receiver 444 has a retaining band 450 on the projection 442. The supply passage is defined by an interior passageway 452 of the cartridge mating member 440 that provides fluid communication between the cartridge 12 and the discharge passage through the projection 442 and the body 454 of the cartridge mating member 440. A fillet 458 may be provided between the projection 442 and the body 454. It will be appreciated that moving the projection receiver 444 over the projection 442 may cause some flexure of the projection receiver 444, and moving the projection receiver 444 over the retaining band 450 will cause the greatest flexure of the projection receiver 444. The retaining band 450 may have a smooth surface to facilitate flexure and movement of the projection receiver 444 over the retaining band 450. In some implementations, the retaining band 450 may have a relief area that has a slightly larger interior diameter that the interior diameter of the rest of the projection receiver 444. The retaining band relief area may cause the projection receiver 444 to flex back toward its non-flexed or less-flexed position when the retaining band 450 is aligned with the retaining band relief area. This creates a bias toward the projection receiver 444 to maintain the retaining band relief area aligned with the retaining band 450.

Figure 11:
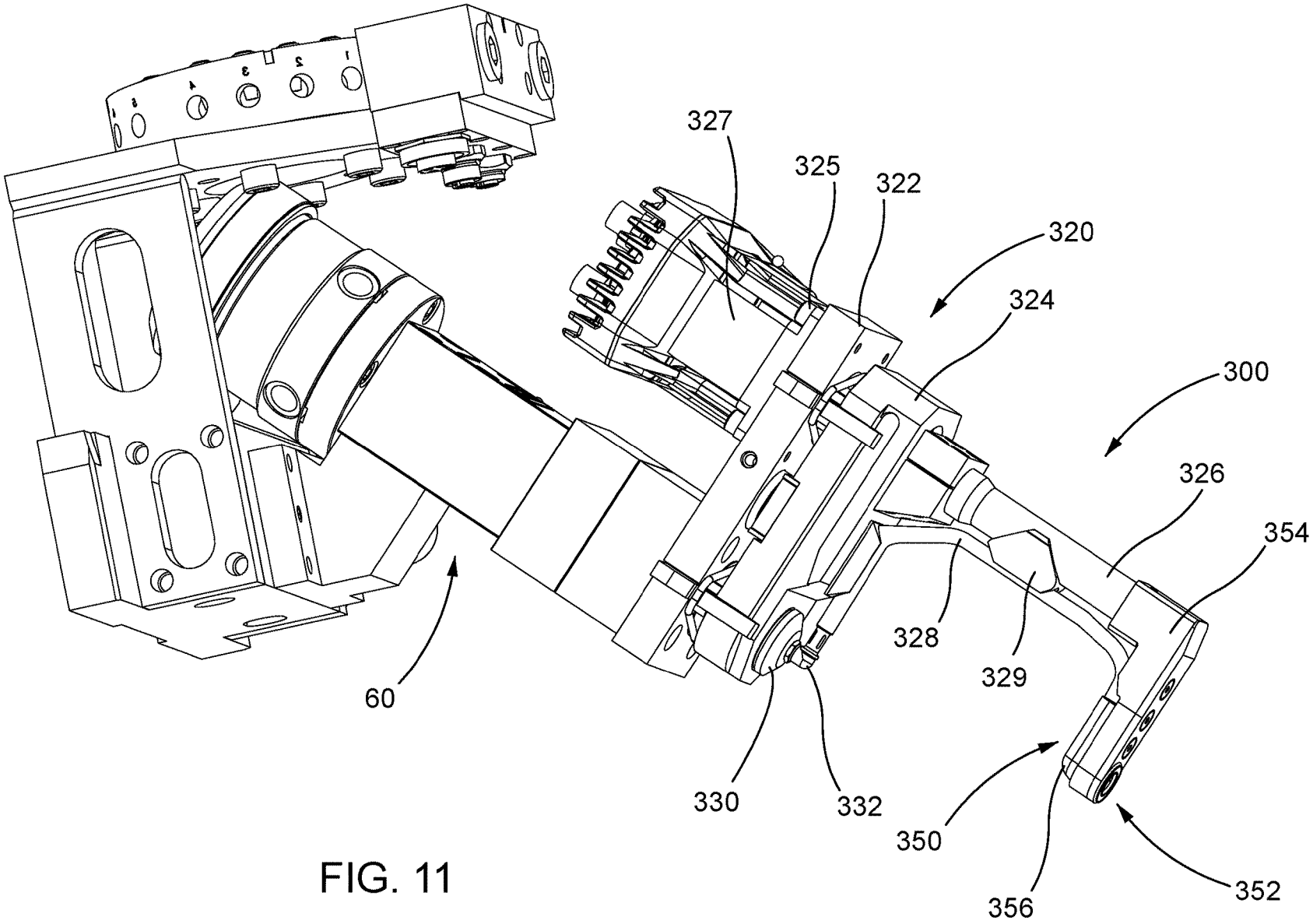
FIG. 11 is an isometric view of an end effector assembly connected to a dispense section of the dispensing apparatus in accordance with the disclosure.
Figure 12:
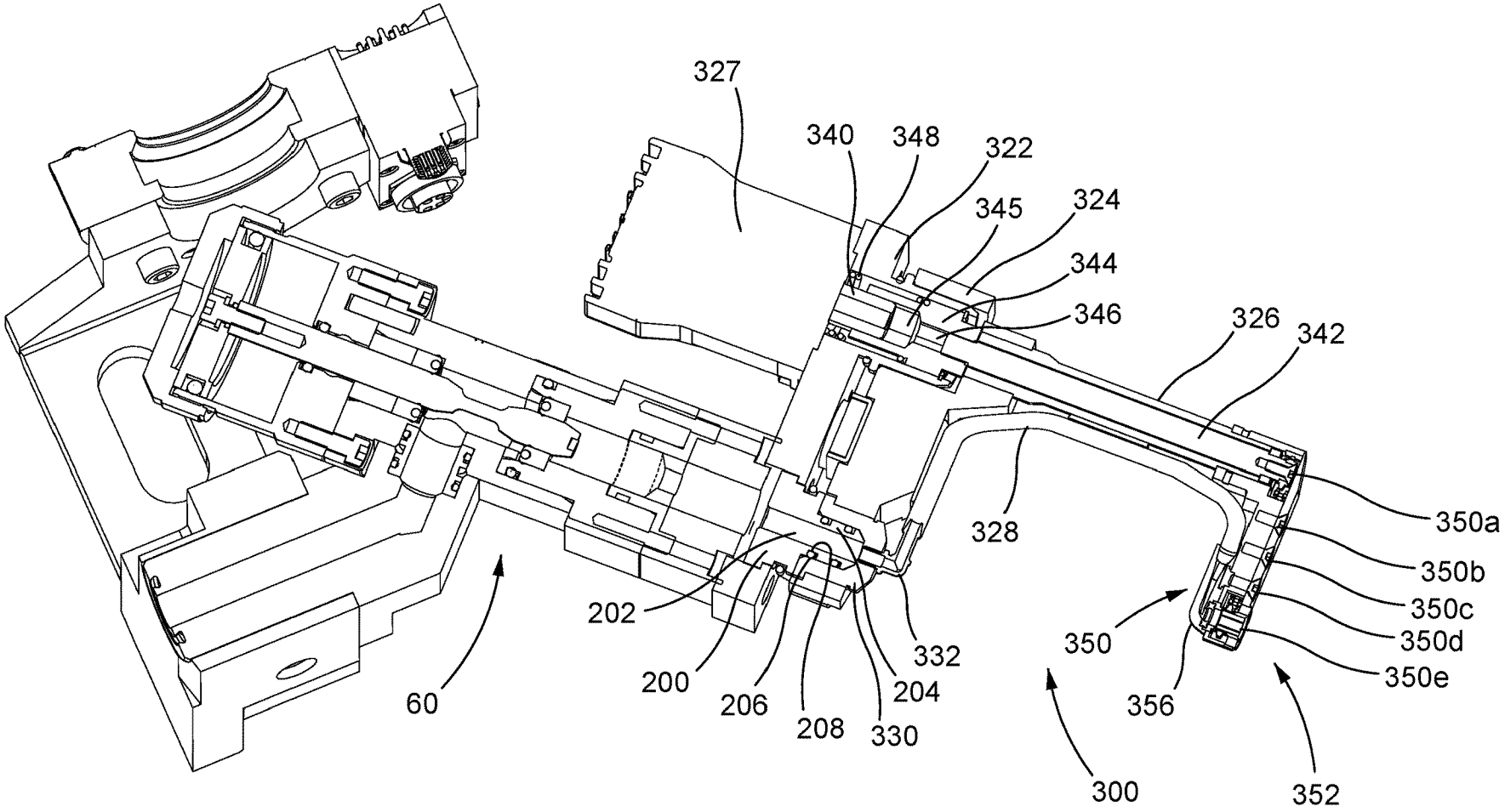
FIG. 12 is a cross-sectional view of the end effector assembly connected to a dispense section of the dispensing apparatus shown in FIG. 11.

Referring to FIGS. 11 and 12, the dispenser 10 may be equipped with an end effector assembly 300. The end effector assembly 300 may be removably attached to the dispense section 40 for dispensing the fluid or adhesive. In one implementation, the end effector assembly 300 may include a dispensing brush. Various types of dispensing brushes may be used, such as those made of ABS-M30 housing, and epoxy set with white horsehair. In other implementations, the brushes may be made from plastic or other suitable material. In an alternative implementation, the end effector assembly 300 may be a nozzle 310 configured to connect directly to the fluid mating member and in fluid communication with the discharge outlet 44 for dispensing fluid from the dispensing apparatus 10, as shown in FIG. 8. In other implementations, the end effector assembly 300 may include material cut-off and/or material handling valves, such as a snuff-back valve, a ball and seat valve, and a rotary valve, among others.

Turning back to FIGS. 11 and 12, the end effector assembly 300 comprises a mounting plate assembly 320 including a motor mounting plate 322 and an end effector mounting plate 324. The motor mounting plate 322 includes motor mounting fasteners 325 for attaching a motor 327 to the motor mounting plate 322. The end effector mounting plate 324 is attached to the motor mounting plate 322. A tube 326 and hose 328 may also be mounted to the end effector mounting plate 324. The fluid mating member 200 extends through a hole in the motor mounting plate 322 and is configured to releasably connect to a fluid mating receiver 330.

As shown in FIG. 12, a hose connection 332 provides a way to connect the hose 328 to the fluid mating receiver 330 and provide fluid communication between the hose 328 and an internal fluid passageway 202 of the fluid mating member 200. The fluid mating receiver 330 is configured to attach in a sealing manner to a fluid mating projection 204 of the fluid mating member 200.

The fluid mating projection 204 of the fluid mating member 200 includes a tapered surface which is dimensioned to fit into the correspondingly dimensioned fluid mating receiver 330. The fluid or adhesive in the interior fluid passageway 202 is transmitted through the fluid mating projection 204 to the fluid mating receiver 330. The fluid mating projection 204 may include fluid mating member seals 206 that reside in fluid mating member seal grooves 208. These seals 206 are located in the seal grooves 208 to ensure that when the end effector assembly 300 is attached to the dispense section 40 of the dispenser 10, the fluid mating projection 204 is fluidly sealed to the fluid mating receiver 330 in order to prevent leakage. The seals 206 may be resilient seals, such as elastomeric O-rings.

The motor 327 includes a power output shaft 340 which connects to a power transmitting shaft 342 via a power transmission mechanism, such as a power coupler 344. The power from the motor 327 is in turn transmitted to the at least one dispensing brush.

The end effector assembly 300 includes an adjustable elongating mechanism 350 comprising a drive chain with drive gears, such as sprockets 350*a*, 350*b*, 350*c*, 350*d*, and 350*e*. In other implementations, the end effector may be driven by a drive belt or gears. At least one brush configured to rotate may be attached to the end of the adjustable mechanism 350. The adjustable mechanism 350 uses the drive chain and drive gears to transmit the rotating motion to the brush. In one implementation, the brush may be attached to the final sprocket 350*e* to allow the brush to rotate. The hose 328 transmits fluid to an axial opening of the brush via a hose connection 332 which is part of the brush mounting assembly 352, and which allows the brush to be connected to the sprocket 350*e*. The drive chain may be covered with a housing 354. A hose housing 356 may provide some protection for the hose 328. Further, a hose clip 329 may attach the hose 328 to the tube 326.

It should be appreciated that the tube 326 may have an octagonal, hexagonal, or other suitably shaped cross section to fit into a correspondingly shaped hole in the end effector mounting plate 324. Also, the brush may be oriented at different angular positions with respect to the end effector mounting plate 324. Further, the tube 326 may also be of different lengths as desired to provide the brush in a desired position.

The end effector assembly 300 is configured to quickly connect and disconnect to the dispense section 40 via an adapter such as the fluid mating member 200. The fluid mating member 200 may be equipped with pivotable attaching fingers 210 each having an oppositely disposed hook shape defining attaching surfaces. The attaching fingers 210 are configured to pivotably engage and secure together the motor mounting plate 322 and the end effector mounting plate 324.

As shown in FIG. 12, the fluid mating receiver 330 is located in the end effector mounting plate 324. In one implementation, the fluid mating receiver 330 is mounted loosely to the end effector mounting plate 324 so that it can "float" by moving radially within the end effector mounting plate 324 to align and position itself during a mating operation with a fluid mating projection 204 of the fluid mating member 200. The fluid mating receiver 330 connects to the hose 328 via a hose connection 332 and allows the inside of the fluid mating receiver 330 to fluidly communicate with the interior of the hose.

The motor mounting plate 322 includes a mounting structure configured to connect to the end effector assembly 300. The motor 327 has a power output shaft 340 that connects to a power coupler 344. The power coupler 344 has a large axial hole 345 in which the power output shaft 340 extends. The exterior of the power output shaft 340 and the interior of the large axial hole 345 may be hexagonally, octagonally, or some other suitably shaped cross section to allow the power output shaft 340 to grip the walls of the large axial hole 345 without spinning with respect to the power coupler 344.

The power coupler 344 also has a small axial hole 346 which also may be be hexagonally, octagonally, or some other suitably shaped cross section to allow the power coupler 344 to attach to the power transmitting shaft 342. It should be appreciated that the power transmitting shaft 342 also may have a corresponding hexagon, octagon, or other suitable shaped cross section in order to allow the power coupler 344 to rotate with and transmit torque from the motor 327 without slipping with respect to the power transmitting shaft 342. A biasing member, such as a spring 348, biases the power coupler 344 toward the power transmitting shaft 342. The power transmitting shaft 342 aids in transmitting rotational energy and torque from the motor 327 to the drive chain.

The end effector assembly 300 attaches to the rest of the dispense section of the dispenser 10 via attaching fingers. When the end effector mounting plate 324 moves toward the motor mounting plate 322, the attaching fingers will pivot over the end effector mounting plate 324 until the motor mounting plate 322 is moved close enough to allow the attaching fingers to snap back due to the urging of the a resilient member, such as a spring, and place the attaching surfaces of the attaching fingers in a locking position on a shoulder of the end effector mounting plate 324. To remove the end effector assembly 300, the attaching fingers are pivoted against the urging of the resilient member, thereby moving the attaching surfaces on the attaching fingers from the shoulder on the mounting plate 322. The end effector assembly 300 may then be separated from the rest of the dispenser 10.

In further implementations of the disclosure, operation of the dispenser 10 may be controlled by a controller or a plurality of controllers connected to various elements of the dispenser 10. Various types of controllers may be used, including local controllers and/or remote controllers. Further, the controllers may have wired or wireless connections.

While the present disclosure has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The claims are therefore not limited to the specific details, representative apparatus and methods and illustrative examples shown and described.

What is claimed is:

1. An apparatus for dispensing fluid from a fluid cartridge having a plunger movable between a proximal end of the fluid cartridge and a distal end of the fluid cartridge, the apparatus comprising:

a housing frame configured to be releasably coupled to a robot;

a cartridge holder including a first clamshell section fixed to the housing frame and a second clamshell section pivotably connected to the first clamshell section, such that the second clamshell section is pivotable between an open position for loading or unloading the fluid cartridge and a closed position for securing the fluid cartridge, the first clamshell section defining a first cartridge holding space configured to receive a first portion of the fluid cartridge and the second clamshell section defining a second cartridge holding space configured to partially receive a second portion of the fluid cartridge, wherein, when the second clamshell section is in the closed position, the first cartridge holding space and the second cartridge holding space together receive the entirety of the fluid cartridge;

a cartridge actuator including a linear actuator and a piston rod configured to urge the plunger from the proximal end of the fluid cartridge to the distal end of the fluid cartridge for discharging fluid from the cartridge;

a dispenser having a dispense valve; and an end effector coupled to the dispenser and configured to dispense the fluid to an application site.

2. The apparatus of claim 1, further comprising a fluid mating connector configured to releasably couple the end effector to the dispenser.

3. The apparatus of claim 1, further comprising a lock configured to secure the second clamshell section in the closed position by clamping the first and second clamshell sections together.

4. The apparatus of claim 3, wherein the lock is connected to a locking actuator fixed to the housing frame and configured to move in and out of locking engagement with the first and second clamshell sections.

5. The apparatus of claim 4, wherein the locking actuator includes a pneumatic driver and a reciprocating rod coupled to the lock.

6. The apparatus of claim 1, wherein the cartridge actuator further comprises a motor, a drive rod coupled to the motor and arranged parallel to the piston rod, and an actuator linkage configured to couple the drive rod to the piston rod.

7. The apparatus of claim 6, wherein the motor is a servomotor, a rotary motor, or a linear motor.

8. The apparatus of claim 1, wherein the piston rod includes a piston head configured to correspondingly interface with a proximal surface of the plunger of the cartridge for urging the plunger through the fluid cartridge during a dispensing operation.

9. The apparatus of claim 8, wherein the piston rod defines an internal piston passageway and the piston head defines an internal piston head passageway, such that the internal piston passageway and the internal piston head passageway are in fluid communication with each other.

10. The apparatus of claim 9, wherein the piston head further comprises a fluid outlet defining at least one vent hole in fluid communication with the internal piston head passageway for providing ventilation in order to prevent a vacuum between the piston head and the plunger.

11. The apparatus of claim 1, wherein the housing frame further comprises at least one robot mounting plate configured to connect to a robotic arm of the robot.

12. The apparatus of claim 1, wherein the dispenser further comprises a discharge passage configured to receive fluid discharged from the cartridge during a dispensing operation.

13. The apparatus of claim 12, wherein the dispenser comprises a discharge outlet in fluid communication with the discharge passage.

14. The apparatus of claim 13, wherein the dispense valve is configured to move between an open position in which fluid flows through the discharge outlet and a closed position in which no fluid flows through the discharge outlet.

15. The apparatus of claim 14, wherein the dispense valve further comprises a valve rod and a snuff back valve.

16. The apparatus of claim 15, wherein the snuff back valve includes a snuff back element provided within a snuff back passage in fluid communication with both the discharge passage and the discharge outlet, and wherein the snuff back element is configured to reciprocate within the snuff back passage by moving forward and backward in response to the dispense valve between a respective flow position and a snuff back position.

17. The apparatus of claim 16, wherein the snuff back element defines a first region and a directly adjacent second region having a cross-sectional diameter smaller than the first region, such that the first region sealingly abuts a resilient valve seal provided at the intersection of the snuff back passage and the discharge outlet when the dispense valve is in the closed position in order to block fluid flow between the discharge passage and the discharge outlet, and the second region does not sealingly abut the valve seal for allowing fluid to flow past the snuff back element toward the discharge outlet when the dispense valve is in the open position.

18. The apparatus of claim 1, wherein the end effector includes a dispense nozzle.

19. The apparatus of claim 1, wherein the end effector includes an applicator brush.

20. The apparatus of claim 1, wherein the fluid cartridge includes a flange, and the first clamshell section and the second clamshell section define a flange groove having a stop surface, wherein the flange groove is configured to receive the flange when the fluid cartridge is secured in the cartridge holder, such that the flange is in contact with the stop surface and axial movement of the fluid cartridge within the cartridge holder is precluded.

21. An apparatus for dispensing fluid from a fluid cartridge having a plunger movable between a proximal end of the fluid cartridge and a distal end of the fluid cartridge, the apparatus comprising:

a housing frame configured to be releasably coupled to a robot;

a cartridge holder defining a cartridge holding space configured to receive the fluid cartridge;

a cartridge actuator including a linear actuator and a piston rod configured to urge the plunger from the proximal end of the fluid cartridge to the distal end of the fluid cartridge for discharging fluid from the cartridge;

a dispenser having a dispense valve;

an end effector coupled to the dispenser and configured to dispense the fluid to an application site; and a cartridge ejector comprising a pneumatic actuator defining an ejector housing and a pneumatic ejector piston mounted for reciprocation within the ejector housing, the pneumatic ejector piston being coupled to an ejector element that is configured to engage and lift at least the distal end of the cartridge to eject the cartridge from the cartridge holding space.

22. A fluid dispensing system for dispensing fluid from a fluid cartridge, the system comprising:

a robot having a robotic arm;

a housing frame mounted to the robotic arm of the robot;

a cartridge holder secured to the housing frame and including a first clamshell section fixed to the housing frame and a second clamshell section pivotably connected to the first clamshell section, such that the second clamshell section is pivotable between an open position for loading or unloading the fluid cartridge and a closed position for securing the fluid cartridge, the first clamshell section defining a first cartridge holding space configured to receive a first portion of the fluid cartridge and the second clamshell section defining a second cartridge holding space configured to partially receive a second portion of the fluid cartridge, wherein, when the second clamshell section is in the closed position, the first cartridge holding space and the second cartridge holding space together receive the entirety of the fluid cartridge;

a cartridge actuator comprising a piston rod and a linear actuator configured to move the piston rod in a reciprocating manner to urge an internal plunger of the fluid cartridge toward a dispensing end of the fluid cartridge;

a dispenser in fluid communication with the dispensing end of the fluid cartridge and having a dispense valve configured to perform a snuff back operation; and an end effector coupled to the dispenser by an adapter and configured to dispense the fluid to an application site.

23. The system of claim 22, wherein the linear actuator comprises a servomotor or a rotary motor.

24. The system of claim 22, wherein the dispense valve further comprises a snuff back valve configured to perform the snuff back operation, the snuff back valve comprising a snuff back element having a first region and a directly adjacent second region having a cross-sectional diameter smaller than the first region, wherein the first region sealingly abuts a resilient valve seal provided in the dispenser when the dispense valve is closed to block fluid flow to the end effector, and wherein the second region does not sealingly abut the resilient valve seal when the dispense valve is open to allow fluid flow past the snuff back valve.

25. The system of claim 24, wherein the dispense valve and the snuff back valve are configured to be simultaneously actuated to a flow position during dispensing.

26. The system of claim 22, wherein the fluid cartridge includes a flange, and the first clamshell section and the second clamshell section define a flange groove having a stop surface, wherein the flange groove is configured to receive the flange when the fluid cartridge is secured in the cartridge holder, such that the flange is in contact with the stop surface and axial movement of the fluid cartridge within the cartridge holder is precluded.

* * * * *